US006168752B1

(12) United States Patent
Kagohashi et al.

(10) Patent No.: US 6,168,752 B1
(45) Date of Patent: Jan. 2, 2001

(54) PROCESS FOR PRODUCING METAL POWDERS AND APPARATUS FOR PRODUCING THE SAME

(75) Inventors: Wataru Kagohashi; Takefumi Irie; Hideo Takatori, all of Chigaski (JP)

(73) Assignee: Toho Titanium Co., Ltd., Chigasaki (JP)

( * ) Notice: Under 35 U.S.C. 154(b), the term of this patent shall be extended for 0 days.

(21) Appl. No.: 09/117,509

(22) PCT Filed: Dec. 1, 1997

(86) PCT No.: PCT/JP97/04380

§ 371 Date: Jul. 31, 1998

§ 102(e) Date: Jul. 31, 1998

(87) PCT Pub. No.: WO98/24577

PCT Pub. Date: Jun. 11, 1998

(30) Foreign Application Priority Data

Dec. 2, 1996 (JP) ..... 8-336356

(51) Int. Cl.[7] ..... B22F 9/22

(52) U.S. Cl. ..... 266/171; 266/905; 75/359; 75/360; 75/365; 75/369

(58) Field of Search ..... 75/359, 360, 365, 75/367, 369; 266/171, 200, 905; 423/493

(56) References Cited

U.S. PATENT DOCUMENTS 2,556,763 * 6/1951 Maddex ..... 266/905
3,649,242 * 3/1972 Arias ..... 75/359
4,086,084 * 4/1978 Oliver et al. ..... 423/443
4,383,852 5/1983 Yoshizawa .
5,853,451 * 12/1998 Ishikawa ..... 75/367

FOREIGN PATENT DOCUMENTS 55-16220 * 4/1980 (JP) ..... 266/905
59-7765 2/1984 (JP) .
61-60123 12/1986 (JP) .
62-192507 * 8/1987 (JP) ..... 75/367
4-365806 12/1992 (JP) .
6-122906 * 5/1994 (JP) .

* cited by examiner

*Primary Examiner*—George Wyszomierski
(74) *Attorney, Agent, or Firm*—Oliff & Berridge, PLC

(57) ABSTRACT

A process for producing metallic powders a chlorination step for continuously producing chloride gas of metal by reacting metal with chlorine gas, and a reduction step for continuously reducing the metallic chloride gas by reacting the metallic chloride gas produced in the chlorination step with reducing gas. Regulating the feed rate of the chlorine gas can control the feed rate of the metallic chloride gas, whereby the particle diameters of produced metal powders can be stably controlled. Thus, the invention can make the particle diameters stable and arbitrarily control the diameters in the range of 0.1 to 1.0 $\mu$m.

10 Claims, 3 Drawing Sheets

PROCESS FOR PRODUCING METAL POWDERS AND APPARATUS FOR PRODUCING THE SAME

BACKGROUND OF THE INVENTION

1. Technical Field

This invention relates to processes for producing metallic powders such as Ni, Cu and Ag or the like fit for various uses, for example, conductive paste fillers used for electric parts, Ti materials for cladding and catalysts. The invention further relates to apparatuses for producing the metal powders such as above.

2. Background Art

Conductive metallic powders such as Ni, Cu and Ag are useful for internal electrodes of multi-layer ceramic capacitors, particularly, Ni powders are recently closed up for such uses. Of those powders, ultrafine Ni powders produced by a chemical vapor deposition are known to be promising. According to a tendency of smaller size and larger capacity in capacitors, internal electrodes are required to be thin and have low resistance, whereby ultrafine powders of diameters of not only 1 $\mu$m or less, but also 0.5 $\mu$m or less are required.

Up to now, various kinds of processes have been proposed for producing the above mentioned metal powders. For example, Japanese Patent Publication No. S59 (84)-7765 proposes a production method for Ni powders by reducing nickel chloride gas with hydrogen gas, thereby injecting hydrogen gas at a high flow rate to the nickel chloride vapor, then nucleating nickel particles at an interfacial unstable region between the nickel chloride vapor flow and the hydrogen gas flow. Furthermore, Japanese Unexamined Patent Publication (Kokai) No. H4 (92)-365806 proposes a method for producing ultrafine nickel powders with a partial pressure of nickel chloride vapor (hereinafter referred to $NiCl_2$ gas) obtained by heating solid nickel chloride in the range of 0.05 to 0.3, and the reducing method by hydrogen gas at a temperature ranging from 1004 to 1453° C. According to the above processes, ultrafine powders of average particle diameters ranging from 0.1 $\mu$m to a few $\mu$m are formed.

However, the above proposals with respect to the producing process for metallic ultrafine powders imply the following problems since the solid nickel chloride is employed as a primary raw material in the each process.

① As heating solid $NiCl_2$ is an inevitable step for obtaining $NiCl_2$ vapor, it is difficult to stably produce metal chloride vapor. As a result, the partial pressure of $NiCl_2$ gas varies, whereby the produced Ni powders are not uniform in particle diameter.

② The amount of the solid $NiCl_2$ in a vaporizing portion varies during the operation, so that the generation rate of $NiCl_2$ vapor varies, whereby stable operation will not be expected.

③ The solid $NiCl_2$ contains crystal water, so that the process requires a dehydration step to eliminate the oxygen contamination prior to the vaporization step.

④ As vaporization is a slow process in general, a large amount of carrier gas (inert gas such as nitrogen gas or the like) is required for carrying $NiCl_2$ gas to a reducing step and additional energy is also required for heating carrier gas.

⑤ And hence, the partial pressure of $NiCl_2$ gas during the reducing step can not be increased, whereby the reaction rate for producing Ni powders is very slow and a large reactor chamber is required.

Therefore, the invention is completed for solving the above problems, thereby providing processes for producing metal powders and apparatuses for producing the same which can accomplish the following objectives:

1) Stable production of Ni, Cu or Ag powders (ultrafine powders) or the like having average particle diameters ranging from 0.1 to 1.0 $\mu$m.
2) Easy control of the reaction rate.
3) Controlling the entire process by regulating the chlorine gas flow rate, thereby arbitrarily producing metal powders having desired particle diameters.
4) Low energy consumption.

SUMMARY OF THE INVENTION

The present invention provides a method and apparatus for producing ultrafine metal powders, comprising the steps of a chlorination step for continuously producing chloride gas of the metal by reacting the metal with chlorine gas, and a reduction step for continuously reducing the chloride gas directly fed from the chlorination step.

In the moment of contacting the chloride gas with the reducing gas, the metallic particles can be generated in a gas phase reaction. Thus ultrafine particles are generated and grow by virtue that the metallic atoms come into contact with each other and precipitate particles. The particle diameters will vary depending on the conditions such as the partial pressure of the chloride gas and the reduction temperature. According to the invented process for producing the metallic powders, the chloride gas of the metal is produced according to the feed rate of the chlorine gas. Therefore, regulating the feed rate of the chlorine gas can control the amount of the chloride gas of the metal to the reduction step. Moreover, since the chloride gas of the metal is produced by the reaction between the chlorine gas and the metal, the process can eliminate carrier gas for transporting the metal chloride gas when the process condition permits, unlike the process in which the chlorine gas of the metal is produced by heating solid chloride of the metal. Thus, the invention can reduce the cost of the production since the carrier gas and the heating energy are not required.

By mixing inert gas with the chloride gas of the metal produced in the chlorination step, the partial pressure of the chloride gas of the metal in the reduction step can be controlled. Thus, by regulating the feeding rate of the chlorine gas or the partial pressure of the chloride gas of the metal in the reduction step, the particle diameters of the metal powders can be controlled, thereby stabilizing the particle diameter of the metal powders and arbitrarily controlling the mean particle diameter.

The invention also provides an apparatus for producing metallic powders comprising a chlorination furnace for chlorinating the metal filled therein and a reduction furnace for reducing the metal chloride gas produced in the chlorination step. The chlorination furnace comprises a nozzle for feeding raw material therein, a nozzle for feeding the chlorine gas therein, a nozzle for transporting the chloride gas of the metal into the reduction furnace and a nozzle for feeding inert gas which dilutes the chloride gas of the metal into the chlorination furnace. The reduction furnace comprises a nozzle for injecting the metal chlorine gas of the metal into the reduction furnace, a nozzle for feeding the reducing gas into the reduction furnace and a nozzle for feeding the inert gas which can cool the metallic powders as reduced. The chlorination furnace is located at the upper stream of the reduction furnace, the chlorination furnace and the reduction furnace are directly connected, and whereby the chlorination and reduction reaction can substantially proceed simultaneously and continuously.

In the above apparatus for producing metallic powders, the chloride gas of the metal can be generated corresponding to the feed rate of the chlorine gas. Moreover, as the chlorination furnace and the reduction furnace are directly connected, regulating the feed rate of the chlorine gas can control the amount of the chloride gas of the metal supplied to the reduction furnace. The chlorination furnace equips the inert gas feeding nozzle, thereby controlling the partial pressure of the chloride gas of the metal in the chlorination furnace. Therefore, the invented apparatus for producing metallic powders also can control the particle diameters by regulating the feed rate of the chlorine gas or the partial pressure of the chloride gas of the metal fed to the reduction furnace. And hence, the apparatus has the same advantages as above, thereby producing the metallic powders and arbitrarily controlling the particle diameters stably.

DETAILED DESCRIPTION OF THE PREFERRED EMBODIMENTS

A preferred embodiment of the invention will be explained hereinafter referring to the accompanied drawings.

A. Chlorination Step

Figure 1:
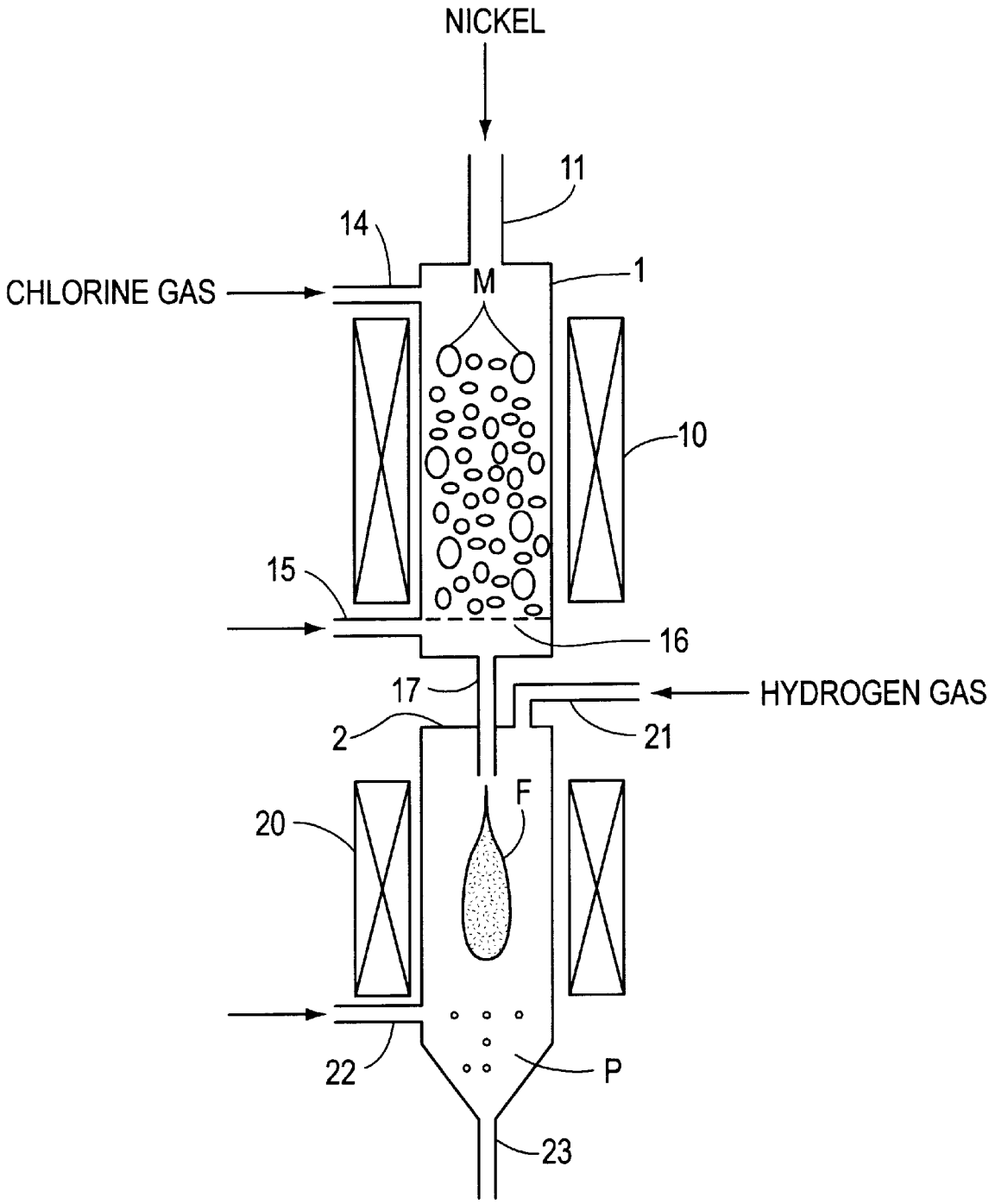
FIG. 1 is an example of apparatus for producing metallic powders according to the invention.

The chlorination step is preferably carried out by a chlorination furnace 1 shown in FIG. 1. A nozzle 11 for providing a raw material Ni (M) is provided on the upper end surface of the chlorination furnace 1. A nozzle 14 for feeding chlorine gas is connected to the upper side of the chlorination furnace 1. A nozzle 15 for feeding inert gas is connected to the lower side of the chlorination furnace 1. A heating unit 10 is located around the chlorination furnace 1. A nozzle 17 for feeding Ni chloride gas is connected to the lower end surface of the chlorination furnace 1. A vertical or horizontal type of furnace, can be applicable for the chlorination step. The vertical type of furnace is suitable for performing uniform solid-gas contact reaction. Chlorine gas is continuously introduced through the nozzle 14 at the target gas flow rate. The chlorination furnace 1 and other parts are preferably made of quartz glass. The nozzle 17 is connected to the upper end surface of the following reduction furnace 2, thereby functioning for transporting $NiCl_2$ gas produced in the chlorination furnace 1 to the reduction furnace 2. The lower end of the nozzle 17 projects into the reduction furnace 2, thereby functioning as an injection nozzle of $NiCl_2$ gas. It should be noted that a wire net 16 shown in FIG. 1, preferably located at the bottom of the chlorination furnace 1, can support the metallic Ni (M) materials thereon. There is no limitation of the form of the metallic Ni (M) as a primary raw material. However, in view of the contact efficiency with the gas and prevention of the pressure increase, the metal Ni (M) preferably has a granular-form with particle diameters ranging from 5 to 20 mm, a lump-form, or a plate-form, as a raw material, and the purity thereof being preferably about 99.5% or more. The height of the metal Ni (M) column is chosen in a suitable range according to the chlorine gas flow rate, the operation temperature of the chlorination furnace 1, the continuous operation time and the form of the metal Ni (M). The operation temperature of the chlorination furnace 1 is approximately 800° C. or more for accelerating the reaction rate therein, in principle up to the melting point of Ni (1483° C.). In view of the reaction rate and the life of the chlorination furnace 1, the operation temperature in the chlorination furnace 1 is chosen preferably in the range of 900 to 1100° C. for practical use.

In the process for producing metal powders of the invention, chlorine gas is continuously fed into the chlorination furnace 1 filled with the metal Ni (M), whereby $NiCl_2$ gas is continuously produced. In this condition, the amount of $NiCl_2$ gas is controlled by the feed rate of the chlorine gas. And hence, the following reduction step is also controlled simultaneously, whereby a desired product of Ni powders can be produced. The detailed operation for feeding chlorine gas is concretely explained in the following reduction step.

The $NiCl_2$ gas produced in the chlorination step is transported in the reduction step through the nozzle 17 without any mixture gases. Alternatively, inert gas such as nitrogen or argon gas can be introduced and mixed with the produced $NiCl_2$ gas through the nozzle 15 for the inert gas in the range from 1 to 30 mole %, whereby the mixed gas is transported in the reduction step. The fraction of the inert gas is a factor for controlling the particle diameters of the Ni powders. A high inert gas fraction leads to the high consumption of inert gas, big energy loss and poor economy. From such a point of view, the partial pressure of the $NiCl_2$ gas passing through the nozzle 17 is preferably desired in the range from 0.5 to 1.0 when the total pressure of the mixture gas is defined as 1.0. Particularly, when Ni powders with small particle diameters in the range of 0.2 to 0.5 $\mu$m are required, the partial pressure is preferably chosen in the range from 0.6 to 0.9. As mentioned above, the amount of produced $NiCl_2$ gas can be arbitrarily controlled, and the partial pressure of the $NiCl_2$ gas can also be controlled by regulating the fraction of the inert gas.

B. Reduction Step

The $NiCl_2$ gas produced in the chlorination step is continuously transported in the reduction step. The reduction step is preferably carried out with a reduction furnace 2 shown in FIG. 2. A nozzle of the transfer/nozzle (hereinafter referred to simply "nozzle") 17 is downwardly projected into the reduction furnace 2. A nozzle 21 for hydrogen gas is connected to the upper surface of the reduction furnace 2. A nozzle 22 for cooling gas is connected to the lower side of the reduction furnace 2. A heating unit 20 is located around the reduction furnace 2. As mentioned below, the nozzle 17 has a function of injecting the $NiCl_2$ gas (inert gas can be included) at a preferable flow rate into the reduction furnace 2 from the chlorination furnace 1.

As long as the reaction of $NiCl_2$ gas with hydrogen gas continues, a luminous flame (hereinafter referred to "flame") F, which is similar to a burning flame of gaseous fuel such as LPG, is formed downwardly from the lower end of the nozzle 17. The feed rate of the hydrogen gas into the reduction furnace 2 is chosen in the range from 1.0 to 3.0 times, preferable range from 1.1 to 2.5 times more compared to the amount of the $NiCl_2$ gas equivalent, which coincides with the chemical equivalent of the chlorine gas fed into the chlorination furnace 1, but the feed rate of the hydrogen gas is not limited to the above ranges. When the hydrogen gas is excessively supplied, the injection stream of the $NiCl_2$ gas from the nozzle 17 is turbulent, the reducing reaction becomes unstable, and unreacted gas is leaked, thereby bringing the unwilling economy loss. Moreover, the high reaction temperature is required for completing the reaction. The temperature is preferably chosen in the range lower than the melting point of pure Ni since solid Ni powder is easy for handling. In view of the reaction rate, the life of the reduction furnace 2 and the economy, the practical temperature is desired in the range from 900 to 1100° C., but the invention does not limit this temperature range.

As mentioned above, the chlorine gas fed into the chlorination step is converted into the $NiCl_2$ gas, thereby being a raw material for the following reduction step. The $NiCl_2$ gas or the $NiCl_2$ inert gas mixture is injected from the end of the nozzle 17. The linear velocity of the gas stream is chosen so that the particle diameters of the obtained Ni powders can be stable. That is to say, when the nozzle diameter is constant, the particle diameters of the Ni powders produced in the reduction furnace 2 are controlled in the desired range according to the feed rate of the chlorine gas and the inert gas. The linear velocity of the gas stream (the linear velocity means the velocity at the reduction temperature) is preferably chosen in the range from 1 m/sec to 30 m/sec at the reduction temperature range from 900 to 1100° C. In case that Ni powders of small diameters ranging from 0.1 to 0.3 /$\mu$m are required, the linear velocity of the gas stream is to be chosen in the range from 5 m/sec to 25 in/sec. In case that Ni powders of diameters ranging from 0.4 to 1.0 $\mu$m are required, the linear velocity of the gas stream is to be chosen in the range from 1 m/sec to 15 m/sec. The linear velocity along the hydrogen gas stream in the reduction furnace 2 is chosen in the range of 1/50 to 1/300 times lower than the injection velocity (linear velocity) of the $NiCl_2$ gas, preferably in the range of 1/80 to 1/250 times lower than the injection velocity. Therefore, the reduction reaction will occur as if the $NiCl_2$ gas from the nozzle 17 is injected into a static hydrogen atmosphere. It should be noted that the direction of the hydrogen gas flow is preferably kept away from the flame F.

In this invented process, when the chlorine gas flow rate increases, the Ni powders in the reduction step become small. On the contrary, when the chlorine gas flow rate decreases, the Ni powders become large. As mentioned above, the partial pressure of the $NiCl_2$ gas can be controlled by mixing the inert gas thereto in the vicinity of the outlet port of the chlorination furnace 1. For example, 1 to 30 mole % of the inert gas can be mixed to the $NiCl_2$ gas. By increasing the partial pressure of the $NiCl_2$ gas, the Ni powders diameter increases. On the contrary, by decreasing the partial pressure of the $NiCl_2$ gas, the Ni powder diameter decreases.

C. Cooling Step

The invented process can prepare a cooling step. The cooling step is conducted in the lower portion of the reduction furnace 2 as shown in FIG. 1. Alternatively, another cooling chamber can be connected to the outlet port of the reduction furnace 2. It should be noted that the term "cooling" as used herein is intended to include the operation for restricting or stopping the growth of the Ni particles in the gas stream (including hydrochloric acid as a by-product). Specifically, the gas stream of approximately 1000° C. can rapidly be cooled in the temperature range from 400 to 800° C. The gas stream can also be cooled to the temperature lower than that range.

As a preferable example for the cooling step, inert gas is injected near the lower end portion of the flame F. Specifically, by injecting nitrogen gas from a cooling gas nozzle 22, the gas stream can also be cooled. By injecting the cooling gas, the Ni particle diameters are controlled while preventing the Ni powders P from agglomeration. The cooling gas inlet nozzle 22 can be opened at one or more locations apart from each other along the vertical direction of the reduction furnace 2. And hence, the cooling condition is optionally chosen so that the particles diameters can be accurately controlled.

D. Collecting Step

The produced gas containing the Ni powders, the hydrochloric acid gas and the inert gas are introduced to the collecting step, whereby only the Ni powders are separated and collected from the produced gas. A bag filter, a hydraulic collector, an oil collector or a magnetic collector, alternatively a combination of one or more thereof can be used for the collecting unit, but is not limited to the above units. Specifically, in case that the Ni powders P are collected through the bag filter, the produced gas containing the Ni powders P, the hydrochloric acid gas and the inert gas is introduced into the bag filter. After separating only the Ni powders P from the produced gas, the residual gas is transported into the washing step. In case that an oil collector is employed, normal paraffin with 10 to 18 carbons atoms or light fuel oil is desirable for the oil. Examples of the fluid for a hydraulic or oil collector are polyoxyalkylenglycol, polyoxyplopylenglycol or derivative thereof (monoalkylether, monoester), surfactant such as sorbitan or sorbitan monoester, well known antioxidants such as phenol-base or amine-base metal deactivator typified by benzotrizole. They may be employed individually or in the mixture of the above surfactants of the concentration range from 10 to 1000 ppm for the prevention of the agglomeration and corrosion of the metal powders.

E. Another Embodiment

Figure 2:
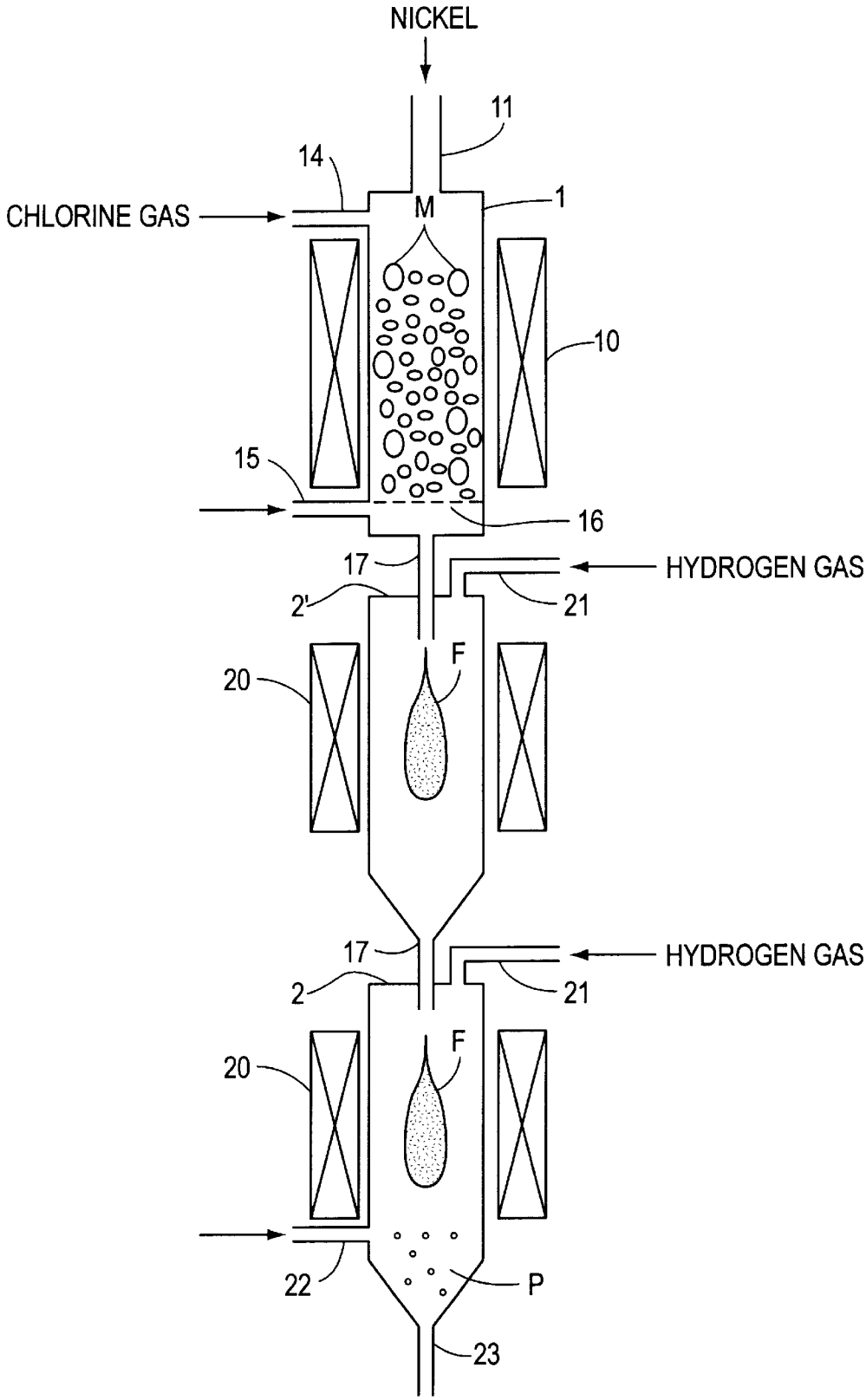
FIG. 2 is another embodiment of an apparatus for producing metal powders according to the invention.

In the above embodiment, the reduction step may be divided into the double stages. FIG. 2 shows an example in which the reduction step is divided into two stages. The same numerals are described on the same components shown in FIG. 1. As shown in FIG. 2, the cooling gas nozzle 22 is installed to only in the reduction furnace 2 of the second reduction stage, but is not installed to the reduction furnace 2' of the first reduction stage. The flow rate of the hydrogen gas fed into the first reduction stage is controlled at 0.5 to 0.9 times lower than the chemical equivalent of the $NiCl_2$ gas. The insufficient hydrogen gas is compensated at the second reduction stage, whereby the hydrogen gas is totally supplied at 1.0 to 2.5 times more than that of the $NiCl_2$ gas. These steps permit further accurate control of the particle diameters in the wide range. It should be noted that a suitable amount of $NiCl_2$ gas may be charged in the portion of the outlet port of the reduction furnace 2' if necessary.

The reduction step is thus divided into duplicated steps, whereby the mixing state of the gas stream in the reduction furnaces 2, and 2' can be improved from a mixing flow to a plug flow. As a result, the residence time of the Ni particles in the reduction furnace 2 and 2' can be uniform, whereby the growing time of the Ni particles can be uniform. Thus obtained Ni powders have uniform diameters. It should be noted that the entire volume of the reduction furnace should be kept constant. In this construction, the residence time distribution of the Ni powders can be close to that of the plug flow, keeping average residence time constant, whereby further accurate control of the particle diameter is accomplished.

On the contrary, in the prior art process for producing Ni powder using solid $NiCl_2$ as a raw material and vaporizing it for the reduction, it may be difficult to control the vaporization rate of the solid. Moreover, as the process needs sublimation of solid $NiCl_2$, a large amount of the inert gas should be fed into the vaporizing zone of the solid $NiCl_2$ for transporting $NiCl_2$ gas into the reduction furnace. Therefore, it is difficult to increase the partial pressure of the $NiCl_2$ gas and to control the process. However, the invention make it possible to control the production rate of NiCl, gas, and hence, the process can be easily and stably controlled.

It should be noted that the invention can be applicable to other metals for example Cu, Ag or the like using those metals as a raw material, choosing temperatures for chlorination and reduction. The detail of the invention is hereinafter explained referring to examples.

EXAMPLES 1

Figure 3:
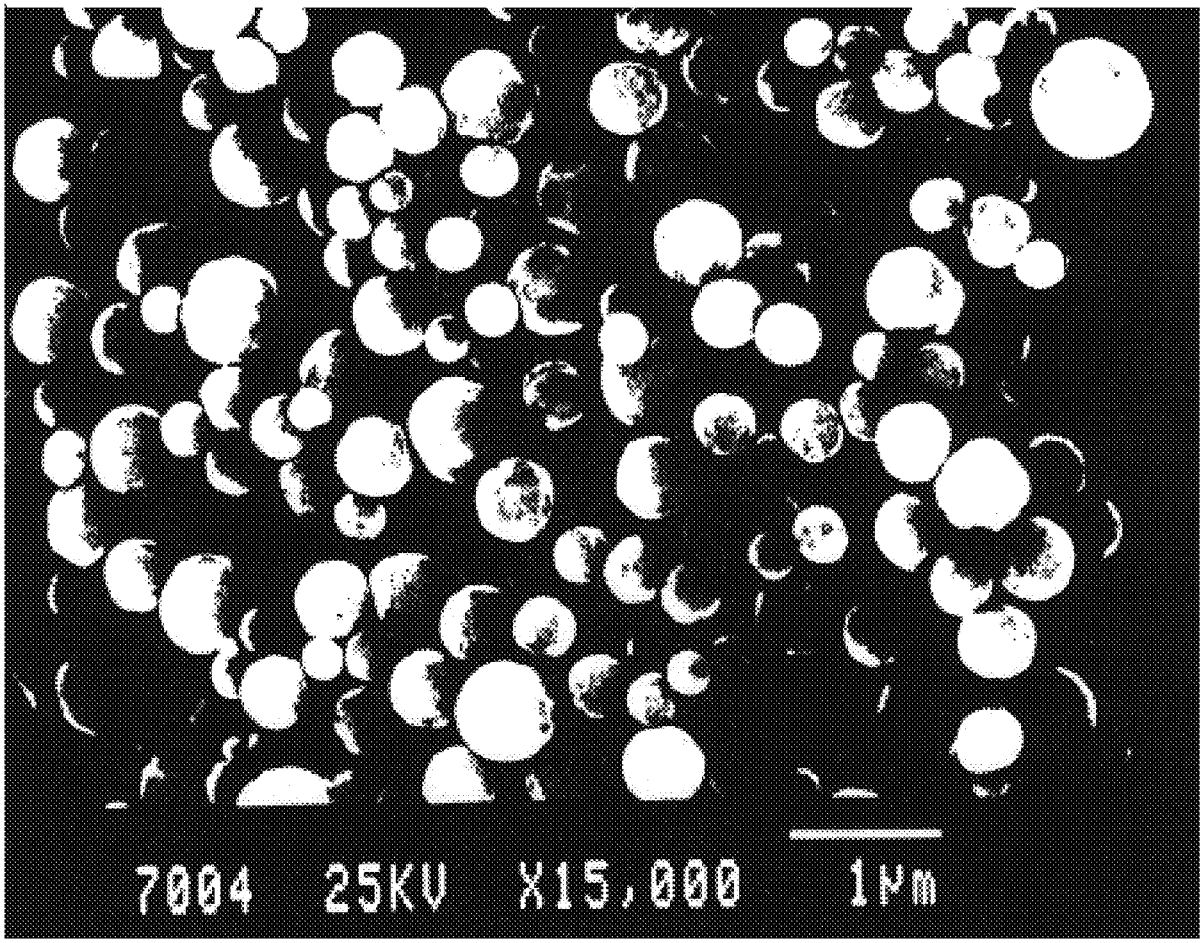
FIG. 3 is an example of SEM photograph showing Ni powders produced by the invention.

15 kg of Ni powders of an average particle diameter of 5 mm was charged into the chlorination furnace 1 of the apparatus shown in FIG. 1 for producing metal powders. The furnace (1) temperature was elevated to 1100° C., and chlorine gas was fed therein at a flow rate of 4Nl/min for the chlorination of the metal Ni and producing $NiCl_2$ gas. Nitrogen gas was added to the $NiCl_2$ gas at 10% (mole ratio) with respect to the amount of chlorine gas. The mixture of the $NiCl_2$ gas and the nitrogen gas were injected at a flow rate of 2.3 m/sec (converted at 1000° C.) from the nozzle 17 into the reduction furnace 2 at 1000° C. At the same time, hydrogen gas was fed at a flow rate of 7Nl/min from the upper portion of the reduction furnace 2 for reducing $NiCl_2$ gas. Thereafter, the produced gas including the Ni powder produced by the reduction was cooled by nitrogen gas at a cooling step. Then, the mixture of the nitrogen gas, the vapor of hydrochloric acid and the Ni powder was transported to an oil scrubber, whereby Ni powder was separated. The Ni powder was washed with xylen and dried, whereby product of Ni powder was obtained. Thus obtained Ni powder had an average particle diameter of 0.70 $\mu$m (measured by BET method) and a spherical configuration. The average particle diameter observed by an SEM photograph was 0.80 $\mu$m, which approximately coincided with the particle diameter observed by the BET method. The result clarifies that the surfaces of the Ni powders are as smooth as the SEM photographs example shown in FIG. 3. The process operation of the invention was stably carried out for 10 hours, the amount of supplied hydrogen gas and nitrogen gas per 1 g of Ni powder were 0.668 Nl and 0.038NI respectively.

EXAMPLE 2

Ni powders were produced using the apparatus shown in FIG. 1 in the same temperature condition as Example 1 and the flow rate condition shown in Table 1. As shown in Table 1, the particle diameters became small according to increase of the flow rate of the chlorine gas.

EXAMPLE 3

Ni powder was produced using the producing apparatus shown in FIG. 1 in the same temperature conditions as Example 1 and the flow rate condition shown in Table 1. As shown in Table 1, the particle diameters became small according to the decrease of the partial pressure of the $NiCl_2$ gas.

TABLE 1

| Example No. | $Cl_2$ gas Flow rate Nl/min | $N_2$ gas Flow rate Nl/min | $NiCl_2$ Partial Pressure | $H_2$ gas Flow rate Nl/min | Product Ni Particle Diameter $\mu$m |
|---|---|---|---|---|---|
| 1 | 4.0 | 0.4 | 0.9 | 7.0 | 0.70 |
| 2 | 5.0 | 0.5 | 0.9 | 8.8 | 0.60 |
| 2 | 8.0 | 0.8 | 0.9 | 14.0 | 0.35 |
| 2 | 11.0 | 1.1 | 0.9 | 19.3 | 0.20 |

TABLE 1-continued

| Example No. | $Cl_2$ gas Flow rate Nl/min | $N_2$ gas Flow rate Nl/min | $NiCl_2$ Partial Pressure | $H_2$ gas Flow rate Nl/min | Product Ni Particle Diameter $\mu$m |
|---|---|---|---|---|---|
| 3 | 3.2 | 0.8 | 0.8 | 5.6 | 0.60 |
| 3 | 2.8 | 1.2 | 0.7 | 4.9 | 0.45 |
| 3 | 2.0 | 2.0 | 0.5 | 3.5 | 0.30 |

As mentioned above, the invention brings the following merits:

① By controlling feed rate of the chlorine gas, the feed rate of the supply of the metal chloride gas can be controlled, whereby the entire process can be stably operated.

② By virtue of the above, the particle diameters of the product powders can be certainly controlled.

③ Ni, Cu or Ag metal powders of average particle diameters ranging from 0.1 to 1.0 $\mu$m can be easily produced. Particularly, powders of average diameters ranging from 0.2 to 0.4 $\mu$m, which are known to be difficult to produce, can be easily produced.

④ Nitrogen gas and hydrogen gas are efficiently consumed, whereby the factory expenses can be reduced.

INDUSTRIAL APPLICABILITY OF THE INVENTION

The invention is applicable to processes and an apparatuses for producing metallic powders via metallic chlorides.

What is claimed is:

1. A process for producing metallic powders, comprising:

continuously producing a metallic chloride gas by chlorination by reacting a metal with chlorine gas in a chlorination furnace, the metal being selected from group consisting of Ni, Cu and Ag;

continuously reducing the metallic chloride gas produced by the chlorination in the chlorination furnace by introducing the metallic chloride gas into a hydrogen atmosphere in a reduction furnace so as to produce metallic powders, wherein the partial pressure of the metallic chloride gas introduced into the reduction furnace is in the range of 0.5 to 1.0; and continuously introducing an inert gas into the reduction furnace near an end portion of the reduction furnace so as to cool the metallic powders.

2. The process for producing metallic powders according to claim 1, further comprising controlling the diameters of the metallic powders by regulating the feed rate of the chlorine gas during the chlorination in the chlorination furnace.

3. The process for producing metallic powders according to claim 1, wherein the step of continuously reducing the metallic chloride gas comprises feeding hydrogen gas into the reduction furnace at a feed rate of from 1.0 to 3.0 times greater than that rate of the metallic chloride gas during the chlorination in chemical equivalent.

4. The process for producing metallic powders according to claim 1, wherein the metallic powders have a diameter in the range of from 0.1 $\mu$m to 1.0 $\mu$m.

5. The process for producing metallic powders according to claim 1, wherein the metallic powders are spherical shaped.

6. The process for producing metallic powders according to claim 1, wherein the metallic powder is collected by leading the inert gas including the metallic powder through at least one of a bag filter, a hydraulic collector and an oil collector.

7. The process for producing metallic powders according to claim 1, wherein the metallic powder is rapidly cooled to a temperature of 800° C. or less from a temperature in the range of 900° C. to 1100° C.

8. A process for producing nickel powders, comprising:

continuously producing a nickel chloride gas by chlorination by reacting a nickel metal with chlorine gas in a chlorination furnace;

continuously reducing the nickel chloride gas produced by the chlorination in the chlorination furnace by introducing the nickel chloride gas into a hydrogen atmosphere in a reduction furnace so as to produce nickel powders, wherein the partial pressure of the nickel chloride gas introduced into the reduction furnace is in the range of 0.6 to 0.9; and continuously introducing an inert gas into the reduction furnace near an end portion of the reduction furnace so as to cool the nickel powders.

9. An apparatus for producing spherical nickel powders having average diameters in the range of 0.1 to 1.0 $\mu$m, comprising:

a) a chlorination furnace for chlorinating nickel metal contained in the chlorination furnace;

b) a vertical reduction furnace for reducing nickel chloride gas produced in the chlorination furnace to form nickel powders; and c) a cooling zone for cooling the nickel powders, the cooling zone being provided in the vertical reduction furnace;

wherein the chlorination furnace comprises:

a chlorine gas inlet nozzle for feeding a chlorine gas into the chlorination furnace; and a transporting tube for transporting nickel chloride gas produced in the chlorination furnace into the vertical reduction furnace;

wherein the vertical reduction furnace comprises:

a nozzle for injecting the nickel chloride gas from the transporting tube into the vertical reduction furnace;

a reduction gas inlet nozzle for feeding reducing gas into the vertical reduction furnace; and a cooling gas inlet nozzle for continuously providing an inert gas into a lower portion of the vertical reduction furnace so as to form the cooling zone at an outlet portion of the vertical reduction furnace; and wherein the chlorination furnace is located upstream of the vertical reduction furnace, and the chlorination furnace and the vertical reduction furnace are directly connected, whereby chlorination and reduction reactions occur simultaneously and continuously.

10. The apparatus for producing spherical nickel powders having average diameters in the range of 0.1 to 1.0 $\mu$m according to claim 9, wherein:

the vertical reduction furnace having a vertical axis; and the cooling gas inlet nozzle is arranged so as to inject the inert gas in a direction crossing the vertical axis of the vertical reduction furnace.

* * * * *